US005411680A

United States Patent [19]

McCarthy et al.

[11] Patent Number: 5,411,680

[45] Date of Patent: May 2, 1995

[54] CARBURETOR

[75] Inventors: Gerard McCarthy; Roger Bowles, both of Tralee, Ireland

[73] Assignee: Tillotson, Ltd., Tralee, Ireland

[21] Appl. No.: 150,973

[22] Filed: Nov. 12, 1993

[30] Foreign Application Priority Data

Nov. 16, 1992 [IE] Ireland ..... 922821

[51] Int. Cl.[6] ..... F02M 17/04

[52] U.S. Cl. ..... 261/35; 261/51; 261/DIG. 68; 251/262; 251/331

[58] Field of Search ..... 261/51, 35, DIG. 68; 137/636.1; 251/251, 262, 331

[56] References Cited

U.S. PATENT DOCUMENTS

| | | | |
|---|---|---|---|
| 1,821,012 | 9/1931 | Guthrie | 261/51 |
| 2,261,794 | 11/1941 | Carlson et al. | 261/51 |
| 2,476,310 | 7/1949 | Langdon | 251/331 |
| 2,856,148 | 10/1958 | Heathcote et al. | 251/331 |
| 2,869,571 | 1/1959 | Price et al. | 251/331 |
| 2,875,977 | 3/1959 | Stone et al. | 251/331 |
| 3,003,754 | 10/1961 | Phillips | 261/50.1 |
| 3,515,169 | 6/1970 | Berg et al. | 251/331 |
| 3,614,057 | 10/1971 | Hospe | 251/331 |
| 4,861,522 | 8/1989 | Gerhardy et al. | 261/DIG. 68 |
| 5,265,843 | 11/1993 | Kleinhappl | 251/331 |

*Primary Examiner*—Tim Miles

*Attorney, Agent, or Firm*—Harness, Dickey & Pierce

[57] ABSTRACT

A diaphragm-type carburetor has a high speed adjusting needle and a low speed/idle adjusting needle which are independently supplied with fuel from the metering chamber. The path for fuel to the low speed/idle needle has a valve which is controlled by the angular position of the throttle shaft such that when the throttle shutter is closed the valve is open whereas when the throttle shutter is open the valve is closed.

3 Claims, 3 Drawing Sheets

CARBURETOR

The present invention relates to a carburetor. In particular it relates to a diaphragm type carburetor of the kind comprising a carburetor body defining a mixing passage having an air intake side and an engine outlet side, a fuel pump, a throttle shutter mounted within the mixing passage, a throttle shaft for controlling the throttle shutter, and a metering chamber for supplying fuel from the fuel pump into the mixing passage via a high speed adjusting needle and a low speed/idle adjusting needle.

FIGS. 1 and 2 illustrate two prior art carburetors of this kind. In each of these two carburetors the component parts are identified in the following list:

1. Filter screen.
2. Mixing passage (venturi).
6. Fuel pump.
8. Fuel inlet.
10. Throttle shutter.
11A. Primary idle discharge port.
11B. Secondary idle discharge port.
13. Low speed/idle adjusting needle.
14. Metering chamber.
15. Idle fuel adjustment orifice.
20. Main fuel adjustment orifice.
25. High speed adjustment needle.
27. Main nozzle discharge port.

The construction and operation of such carburetors is well known, and needs no further description.

The low speed adjusting needle 13, depending on the design of the carburetor, may operate independently or dependently of the high speed adjusting needle. When the low speed adjusting needle 13 is operable independently of the high speed adjusting needle 25, both the high speed and low speed/idle fuel requirements are independently supplied from the metering chamber 14, as shown in FIG. 1 of the drawings. The correct volume of fuel required for low speed/idle function is set by regulating the low speed adjusting needle 13. The correct volume of fuel required for high speed operation is regulated by the high speed needle 25. Thus, at high speed operation the total correct volume of fuel required is the summation of the fuel regulated by the needles 13 and 25.

It is therefore possible to influence high speed operation by adjusting the low speed adjusting needle 13 setting.

Carburetors set to comply with emission requirements with desirable air/fuel ratios at high speed operation may have a high speed system which is not adjustable; a fixed jet only; a partial fixed jet with limited adjustment on the high speed needle; or a restricted adjustment of the high speed needle. As a portion of the total fuel required for high speed operation is supplied via the low speed needle altering the fuel flow via the low speed needle system can have an adverse effect on emissions by either making the fuel supply mixture outside the optimum limits resulting in a mixture which is too lean or too rich.

To overcome the disadvantages of the independent system of operation described above, a so-called dependent system exists where the low speed/idle fuel supply fed to the low speed needle is taken from a location downstream of the high speed adjusting needle, as shown in FIG. 2 of the drawings. During low speed operation the idle fuel is adjusted by the low speed/idle adjustment needle 13. At high speed operation due to a greater negative pressure at the main fuel discharge port 27, fuel cannot exit from idle discharge ports 11*a*, 11*b*. Back bleeding or movement of air from the idle discharge ports 11*a*, 11*b* to the main fuel discharge port 27 is prevented by capillary seals which exist around the annulus of the low speed needle and seat, and the small channels 80 connecting the low speed adjustment to the high speed adjustment. However, the system dynamics are greatly influenced by many factors which can lead to breaking of the capillary seals in the low speed system leading to (back-bleeding), leakage of air at high speed operation from the low speed system to high speed system. This back bleeding alters the air/fuel ratio at high speed operation, leaning out the mixture. This in turn can have a non-desirable effect on emissions and may result in destruction of the engine.

Factors which can cause the capillary seal to break are incorrect adjustment of the low speed needle, engine vibration, viscosity of the fuel mixture, etc. In general this system is unreliable and may not work on certain engines.

It is an object of the present invention to overcome these problems.

The invention, therefore, provides a diaphragm-type carburetor comprising a carburetor body defining a mixing passage having an air intake side and an engine outlet side, a fuel pump, a throttle shutter mounted within the mixing passage, a throttle shaft for controlling the throttle shutter, and a metering chamber for supplying fuel from the fuel pump into the mixing passage via a high speed adjusting needle and a low speed/idle adjusting needle, the improvement comprising means for enabling fuel to be fed independently from the metering chamber to the mixing passage via the high speed adjusting needle and the low speed/idle adjusting needle, and valve means for controlling the flow of fuel via the low speed/idle adjusting needle so that when the throttle shutter is closed or substantially closed the valve means is open to permit the flow of fuel to the carburetor mixing passage via the low speed/idle adjusting needle, and when the throttle shutter is open or substantially open the valve means is closed to prevent the flow of fuel to the carburetor mixing passage via the low speed/idle adjusting needle.

The invention will be understood in greater detail from the following description of a preferred embodiment thereof given by way of example only and with reference to the accompanying drawings in which:

FIGS. 1 and 2, previously described, are cross-sectional views of two carburetors according to the prior art, FIG. 3 is a side view of a carburetor according to the invention;

Figure 1:
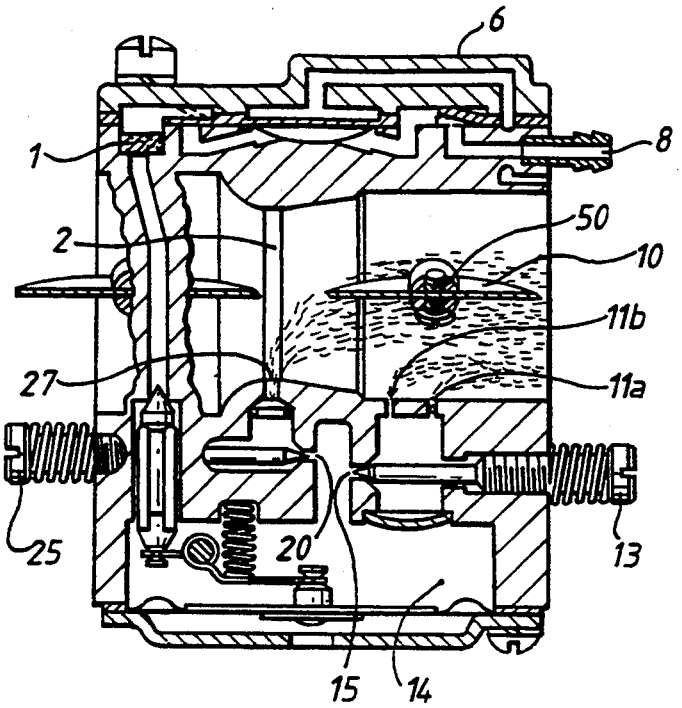
Fig.1. PRIOR ART
Figure 2:
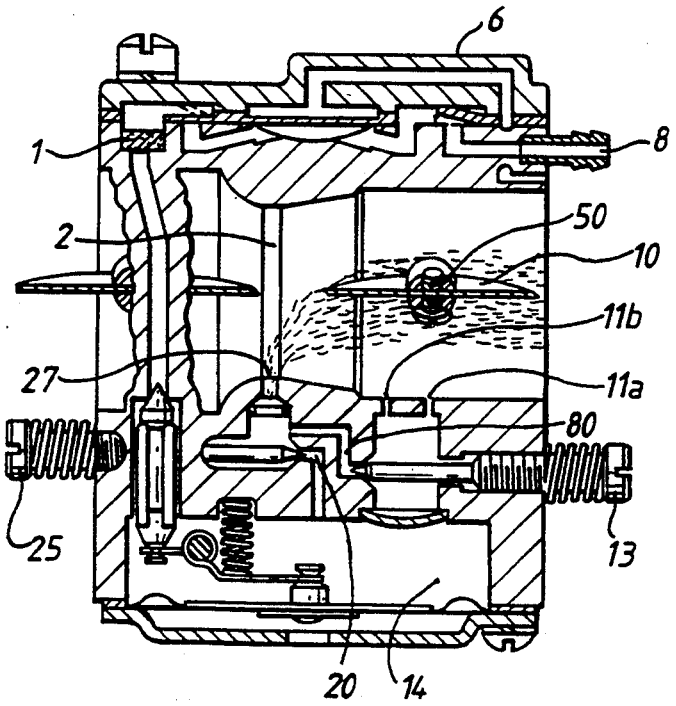
Fig.2. PRIOR ART
Figure 3:
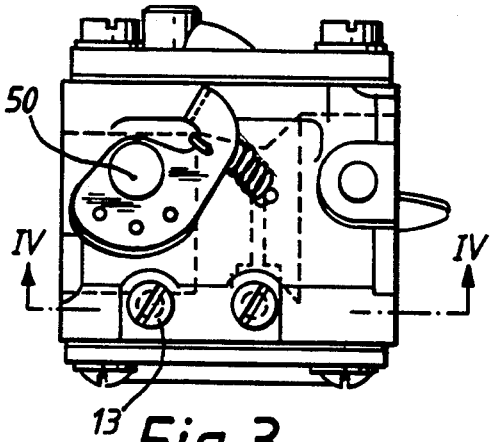
Figure 4:
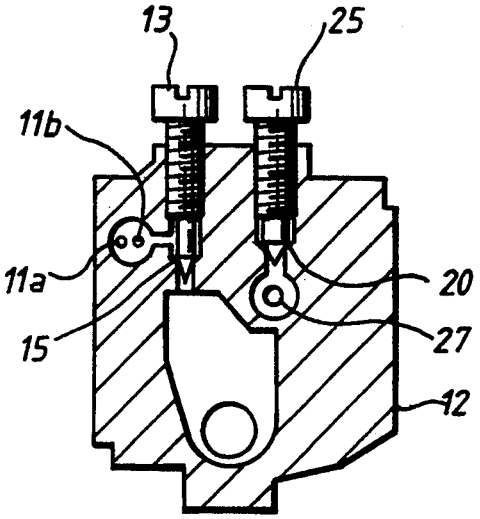
FIG. 4 is a cross-section of the carburetor of FIG. 3 taken along the line IV—IV.
Figure 5:
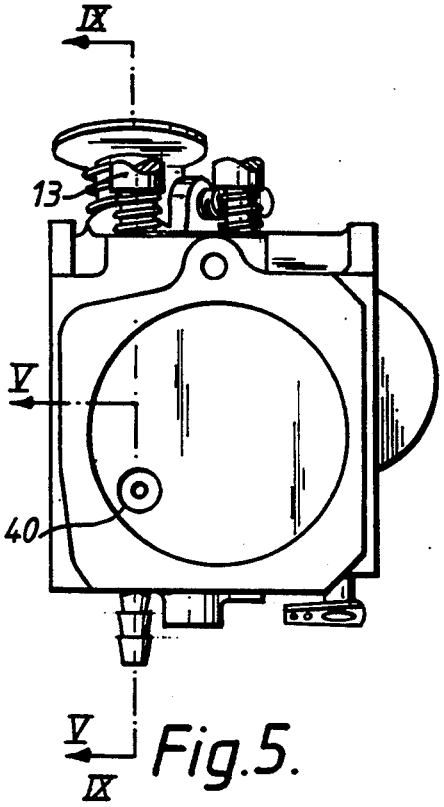
FIG. 5 is a plan view from below of the carburetor of FIG. 3 of the drawings.

Since diaphragm type carburetors are well known in the art, a full description of the operation of the present embodiment is not considered necessary. Accordingly, the present embodiment is different from a conventional carburetor as follows.

Fuel from the metering chamber 14 is fed independently to the idle fuel adjustment orifice 15 and to the main fuel adjustment orifice 20. Prior to the fuel being fed to the orifice 15, it passes through a conduit 30 having a valve means 40 associated therewith.

The valve means 40 comprises a valve chamber. The chamber is divided into two sub-chambers, viz an inlet chamber 42 and an outlet chamber 43. A constriction 44 is present between the sub-chambers 42 and 43 having a seat 45. A closure element 46 is provided which is capable of moving into or out of the constriction 44 so as to allow passage of fuel from the inlet chamber 42 to the outlet chamber 43 but which prevents the flow of fuel when the closure element 46 is acting on the seat 45.

The closure element 46 is resilient and is constructed and arranged so as to be biased into an open condition which permits the flow of fuel from the inlet chamber 42 to the outlet chamber 43. Located in a housing 47 having only side wall(s) 48 is a sphere 49.

The throttle shutter 10 (FIG. 6) is controlled by a throttle shaft 50. The periphery of the throttle shaft 50 has a segmental recess 51 therein in which the sphere 49 may rest. The recess 51 has a shape, size and configuration such that it acts as a cam surface for the sphere 49 which in turns acts as a cam follower. The arrangement is such that upon rotation of the shaft 50 to the angular position shown in FIG. 7, the sphere 49 is displaced downwardly out of the recess 51 thereby pressing against the element 46 thereby causing it to close the constriction 44 and shutting off the flow of fuel from the inlet chamber 42 to the outlet chamber 43. Rotational movement of the shaft 50 in the opposite direction to the angular position shown in FIG. 8 causes the reverse sequence of events.

Figure 6:
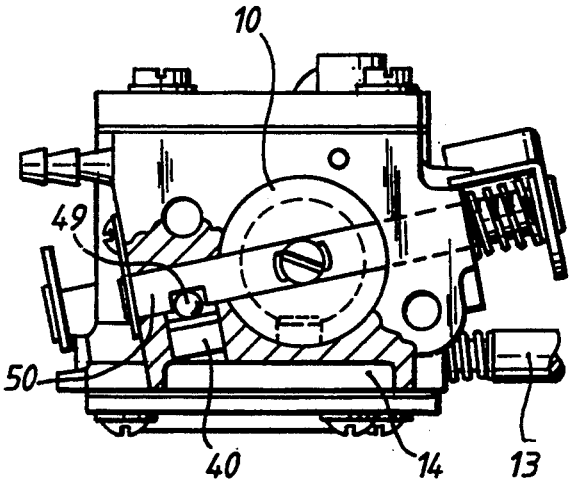
FIG. 6 is a partially cut-away view of the carburetor of FIG. 3 of the drawings.
Figure 7:
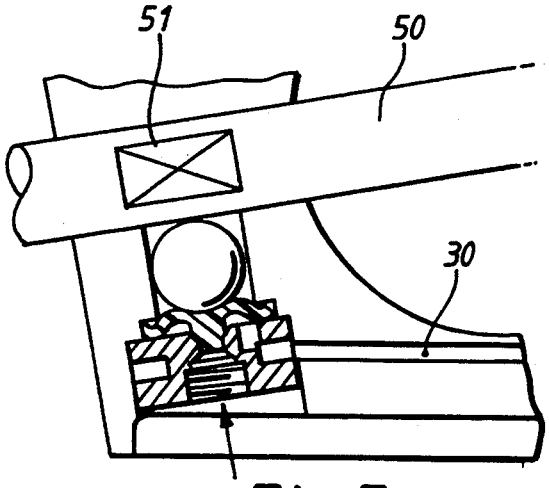
FIG. 7 is a cross-sectional view of the carburetor taken along the line VII—VII of FIG. 5 of the drawings showing a valve in an closed condition of use.
Figure 8:
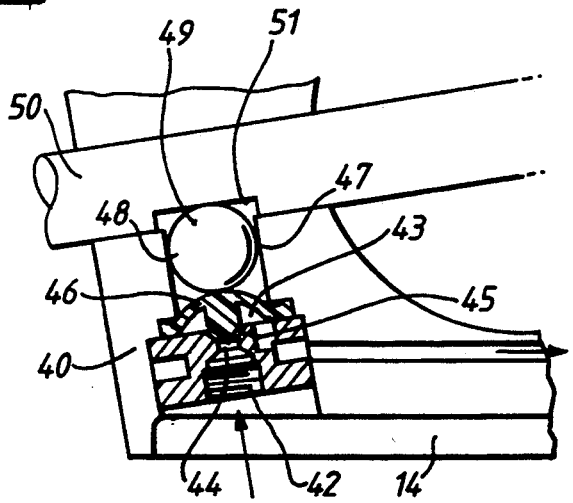
FIG. 8 is a cross-sectional view of the carburetor similar to FIG. 7, but showing the valve in an open condition of use.
Figure 9:
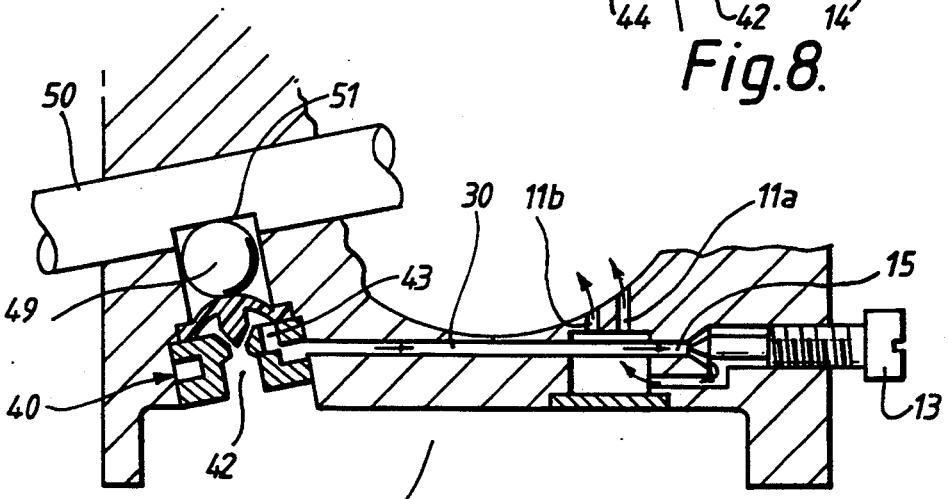
FIG. 9 is cross-sectional view taken along the line IX—IX of FIG. 5 of the drawings.

As will be seen in FIG. 6, the angular position of the shaft 50 shown in FIG. 8 corresponds to the throttle shutter 10 being closed, whereas the angular position of the shaft 50 shown in FIG. 7, being 90 degrees rotated relative to FIG. 8, corresponds to the throttle shutter 10 being open. Thus the valve 40 controls the flow of fuel into the carburetor mixing passage so that when the throttle shutter 10 is closed or substantially closed the valve 40 is open to permit the flow of fuel to the carburetor mixing passage via the low/idle adjusting needle 15, and when the throttle shutter 10 is in the open or substantially open condition the valve 40 is closed to prevent the flow of fuel to the carburetor mixing passage via the low/idle adjusting needle 15.

Thus, the invention provides for the idle fuel supply to be positively shut off at high speed operation. It is, therefore, not possible to influence the high speed air/fuel ratio (emission levels) by increasing or decreasing the idle fuel flow.

The invention is not limited by or to the specific embodiment described which can undergo considerable variation without departing from the scope of the invention.

We claim:

1. In a diaphragm-type carburetor comprising a carburetor body defining a mixing passage having an air intake side and an engine outlet side, a fuel pump, a throttle shutter mounted within the mixing passage, a throttle shaft for controlling the throttle shutter, and a metering chamber for supplying fuel from the fuel pump into the mixing passage via a high speed adjusting needle and a low speed/idle adjusting needle, the improvement comprising means for enabling fuel to be fed independently from the metering chamber to the mixing passage via the high speed adjusting needle and the low speed/idle adjusting needle, and valve means for controlling the flow of fuel via the low speed/idle adjusting needle so that when the throttle shutter is closed or substantially closed the valve means is open to permit the flow of fuel to the carburetor mixing passage via the low speed/idle adjusting needle, and when the throttle shutter is open or substantially open the valve means is closed to prevent the flow of fuel to the carburetor mixing passage via the low speed/idle adjusting needle, wherein the valve means comprises a sphere which is resiliently biased against and acts as a cam follower to the circumference of the throttle shaft, the throttle shaft having a recess in part of its circumference such that the sphere is engaged in or displaced out of the recess according to the rotational position of the throttle shaft, the movement of the sphere into and out of the recess controlling the opening and closing of the valve means.

2. A carburetor according to claim 1, wherein when the throttle shaft is in the position in which the throttle shutter is closed the sphere is engaged in the recess and when the throttle shaft is in the position in which the throttle shutter is open the sphere is displaced out of the recess, the movement of the sphere controlling the action of the valve means such that when the sphere is displaced out of the recess the valve means is closed and when the sphere is engaged in the recess the valve means is open.

3. A carburetor as claimed in claim 2, wherein at least part of the valve means is resilient and provides the resilient bias of the sphere against the throttle shaft.

* * * * *